US009340027B2

(12) United States Patent
Ogasawara

(10) Patent No.: US 9,340,027 B2
(45) Date of Patent: May 17, 2016

(54) INKJET RECORDING APPARATUS

(71) Applicant: CANON KABUSHIKI KAISHA, Tokyo (JP)

(72) Inventor: Seiji Ogasawara, Machida (JP)

(73) Assignee: Canon Kabushiki Kaisha, Tokyo (JP)

( * ) Notice: Subject to any disclaimer, the term of this patent is extended or adjusted under 35 U.S.C. 154(b) by 95 days.

(21) Appl. No.: 13/652,244

(22) Filed: Oct. 15, 2012

(65) Prior Publication Data

US 2013/0100202 A1 Apr. 25, 2013

(30) Foreign Application Priority Data

Oct. 20, 2011 (JP) ..... 2011-230857

(51) Int. Cl.
*B41J 2/165* (2006.01)
*B41J 2/17* (2006.01)

(52) U.S. Cl.
CPC ..... *B41J 2/16526* (2013.01); *B41J 2/1652* (2013.01); *B41J 2/1721* (2013.01); *B41J 2002/1728* (2013.01); *B41J 2002/1742* (2013.01)

(58) Field of Classification Search
None
See application file for complete search history.

(56) References Cited

U.S. PATENT DOCUMENTS

| | | | | |
|---|---|---|---|---|
| 6,910,757 | B2 * | 6/2005 | Kanamitsu et al. | 347/31 |
| 2008/0284835 | A1 * | 11/2008 | Panchawagh et al. | 347/90 |
| 2011/0018931 | A1 * | 1/2011 | Ikeda | 347/29 |

FOREIGN PATENT DOCUMENTS

| | | | |
|---|---|---|---|
| JP | 2000-158678 | A | 6/2000 |
| JP | 2003-72110 | A | 3/2003 |
| JP | 2007-160870 | A | 6/2007 |

* cited by examiner

*Primary Examiner* — Alejandro Valencia
(74) *Attorney, Agent, or Firm* — Canon U.S.A., Inc. IP Division

(57) ABSTRACT

An inkjet recording apparatus includes a recording head configured to discharge ink, a first waste ink retaining member configured to absorb ink discharged from the recording head, a second waste ink retaining member arranged below the first waste ink retaining member, a first inclined surface configured to flow waste ink overflowing the first waste ink retaining member downward, a waste ink receiving surface connected with a bottom end of the first inclined surface and including a porous body sheet for absorbing waste ink, and a second inclined surface configured to flow waste ink overflowing the porous body sheet to the second waste ink retaining member.

10 Claims, 5 Drawing Sheets

INKJET RECORDING APPARATUS

BACKGROUND OF THE INVENTION

1. Field of the Invention

The present disclosure relates to an inkjet recording apparatus in which ink droplets discharged from a recording head to the outside of a recording sheet are guided to a waste ink absorber.

2. Description of the Related Art

Japanese Patent Applications Laid-Open No. 2000-158678 and No. 2007-160870 discuss inkjet recording apparatuses that are configured such that ink droplets discharged from a recording head to the outside of a recording sheet for borderless printing or by a preliminary discharge for the sake of maintenance of the recording head are guided to a waste ink absorber.

Japanese Patent Application Laid-Open No. 2000-158678 discusses a technique for providing a waste ink conduction member in contact with the waste ink absorber and transferring ink droplets, which are discharged into an opening of a platen, to the waste ink absorber through the waste ink conduction member.

Japanese Patent Application Laid-Open No. 2007-150870 discusses a technique for providing a replaceable waste ink absorber immediately below a platen, and flowing ink droplets, which are discharged into an opening of the platen, to the waste ink absorber below through an inclined surface.

According to the technique discussed in Japanese Patent Application Laid-Open No. 2000-158678, however, the waste ink can flow back through the waste ink conduction member to the surface of the platen because of a water head difference if the inkjet recording apparatus is left greatly tilted with a large amount of the waste ink absorbed in the waste ink absorber.

According to the technique discussed in Japanese Patent Application No. 2007-160870, the waste ink absorber of replaceable type complicates the configuration and needs replacement costs. With the technique for using an inclined surface to guide the waste ink to the waste ink absorber, the inclined surface becomes long if the platen opening is arranged away from the waste ink absorber. This contributes to an increase in height of an apparatus.

SUMMARY OF THE INVENTION

The present disclosure is directed to an inkjet recording apparatus, in which waste ink discharged from a recording head is guided to a waste ink absorber without fail and the waste ink will not flow back from the waste ink absorber even if the inkjet recording apparatus is tilted.

According to an aspect disclosed herein, an inkjet recording apparatus includes a recording head configured to discharge ink, a first waste ink retaining member configured to absorb ink discharged from the recording head, a second waste ink retaining member arranged below the first waste ink retaining member, a first inclined surface configured to flow waste ink overflowing the first waste ink retaining member downward, a waste ink receiving surface connected with a bottom end of the first inclined surface and including a porous body sheet for absorbing waste ink, and a second inclined surface configured to flow waste ink overflowing the porous body sheet to the second waste ink retaining member.

Further features and aspects of the present disclosure will become apparent from the following detailed description of exemplary embodiments with reference to the attached drawings.

BRIEF DESCRIPTION OF THE DRAWINGS

The accompanying drawings, which are incorporated in and constitute a part of the specification, illustrate exemplary embodiments, features, and aspects of the disclosure and, together with the description, serve to explain the principles disclosed herein.

DESCRIPTION OF THE EMBODIMENTS

Various exemplary embodiments, features, and aspects of the invention will be described in detail below with reference to the drawings.

An inkjet recording apparatus according to an exemplary embodiment is applicable not only to a printer that only has a recording function (personal computer (PC) printer) but also to a multifunction printer that has a copying function and a facsimile function.

Figure 1:
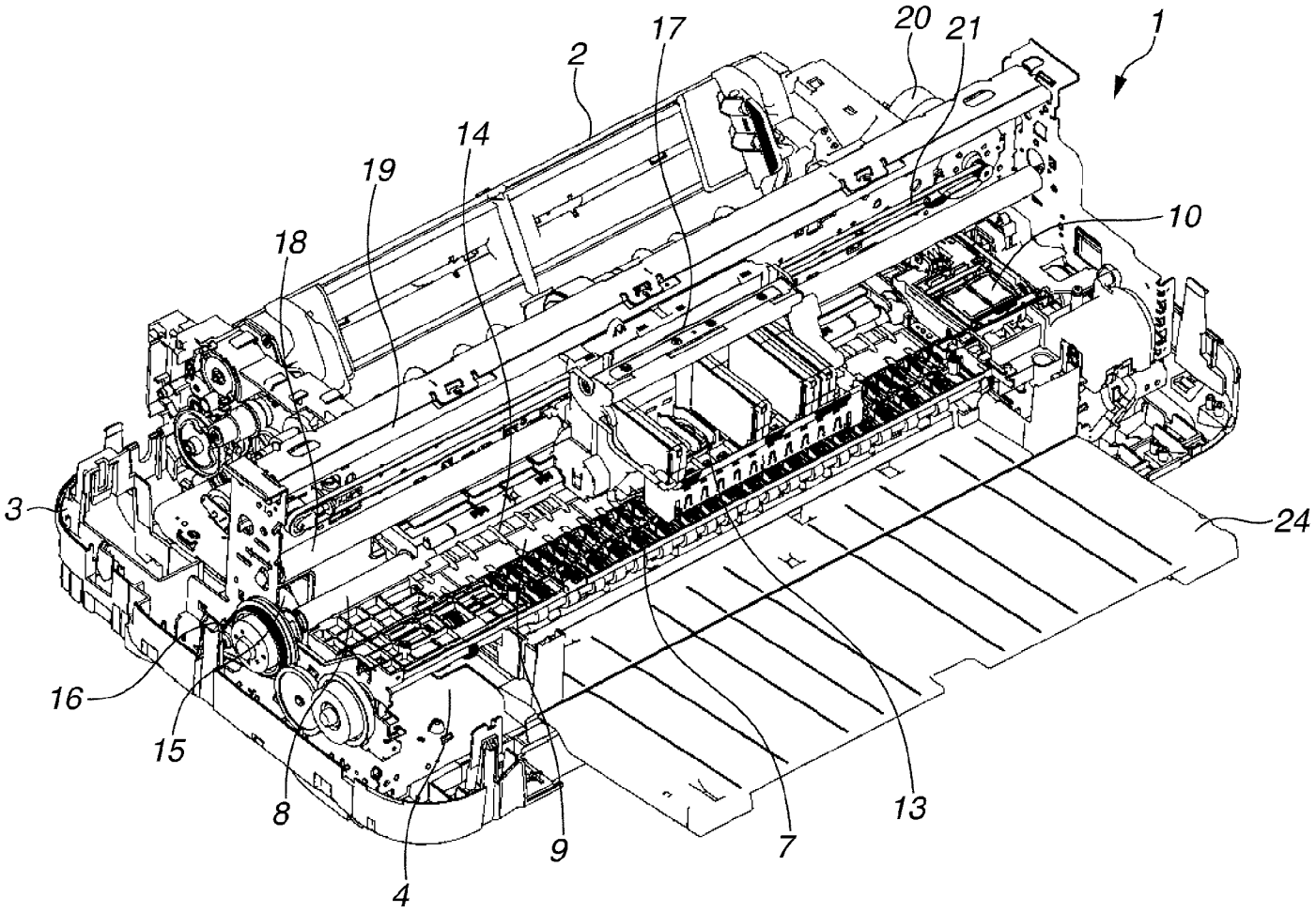
FIG. 1 is a perspective view illustrating an example of an inkjet recording apparatus according to an exemplary embodiment.
Figure 2:
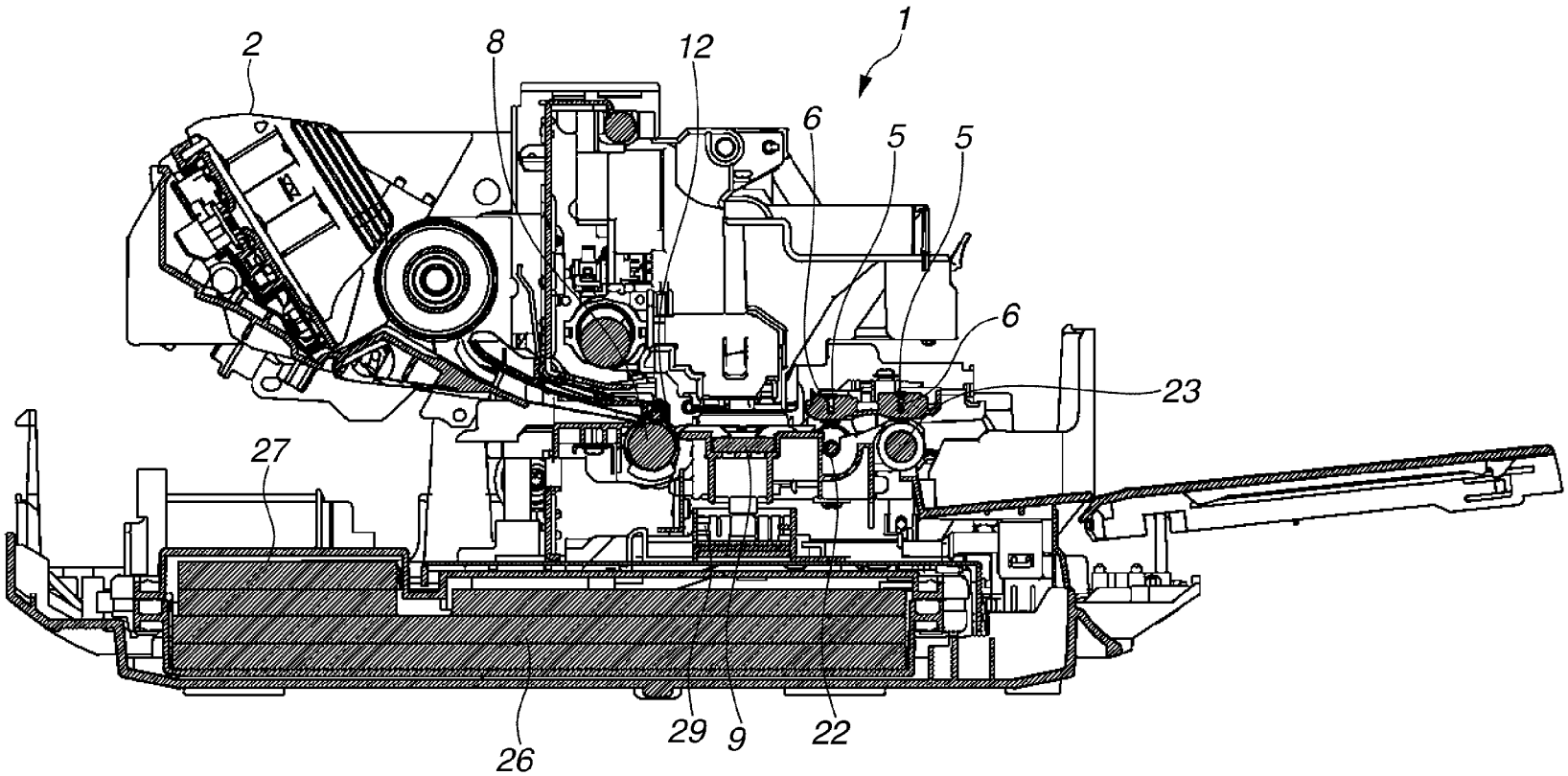
FIG. 2 is a sectional side view of the inkjet recording apparatus according to the exemplary embodiment.

Initially, the entire inkjet recording apparatus will be overviewed. FIG. 1 is a perspective view of the inkjet recording apparatus according to the exemplary embodiment as disclosed herein. FIG. 2 is a sectional side view of the inkjet recording apparatus according to the exemplary embodiment of the present invention.

The inkjet recording apparatus 1 includes a sheet feeding unit 2. The sheet feeding unit 2 separates a topmost recording sheet from a stacked plurality of recording sheets and feeds the separated recording sheet to a conveyance roller 8. The conveyance roller 8 and a pinch roller 12 to be driven by the conveyance roller 8 contact each other to form a conveyance roller nip. A leading edge of the recording sheet conveyed by the sheet feeding unit 2 by a predetermined amount contacts the conveyance roller nip to perform a registration operation (a skew correction operation).

After the registration operation, the conveyance roller 8 conveys the recording sheet onto a platen 14. The recording sheet is held in a position to face a surface of a recording head 13 where recording elements are arranged. The conveyance roller 8 is rotated by a conveyance motor 15, which is a driving source, through a conveyance roller timing belt 16.

Next, the recording head 13 mounted on a carriage 17 discharges ink droplets to the recording sheet which is held on the top surface of the platen 14 while the carriage 17 scans. Recording is thereby performed on the recording sheet. The carriage 17 is supported by a guide shaft 18 and a guide rail 19 so as to perform scanning. The carriage 17 is driven by a carriage motor 20 through a carriage timing belt 21.

The recording head 13 also discharges ink droplets to the outside of the recording sheet when performing recording without leaving a margin on the recording sheet. The ink droplets discharged to the outside of the recording sheet are absorbed by a platen absorber 9 (a first waste ink retaining member) which is arranged in an opening of the top surface of the platen 14. The platen absorber 9 also absorbs ink droplets that are discharged by a preliminary discharge. The preliminary discharge is performed during recording for the sake of maintenance of ink discharge nozzles in the recording head 13. The platen absorber 9 is made of urethane foam which has favorable ink absorbability and permeability.

The conveyance operation of the conveyance roller 8 and the scanning operation of the carriage 17 are repeated to complete recording. The recording-completed recording sheet is discharged onto a sheet discharge tray 24 by an upstream side sheet discharge roller 22, a downstream side sheet discharge roller 23, and a plurality of spur rollers 5. The plurality of spur rollers 5 is driven to rotate by the upstream side sheet discharge roller 22 or the downstream side sheet discharge roller 23. Each of the spur rollers 5 is rotatably supported on a spur roller holder 7 through a spur roller spring 6, which is a rod-like arrangement of coil spring. The spur rollers 5 are pressed against the upstream side sheet discharge roller 22 or the downstream side sheet discharge roller 23.

Figure 3:
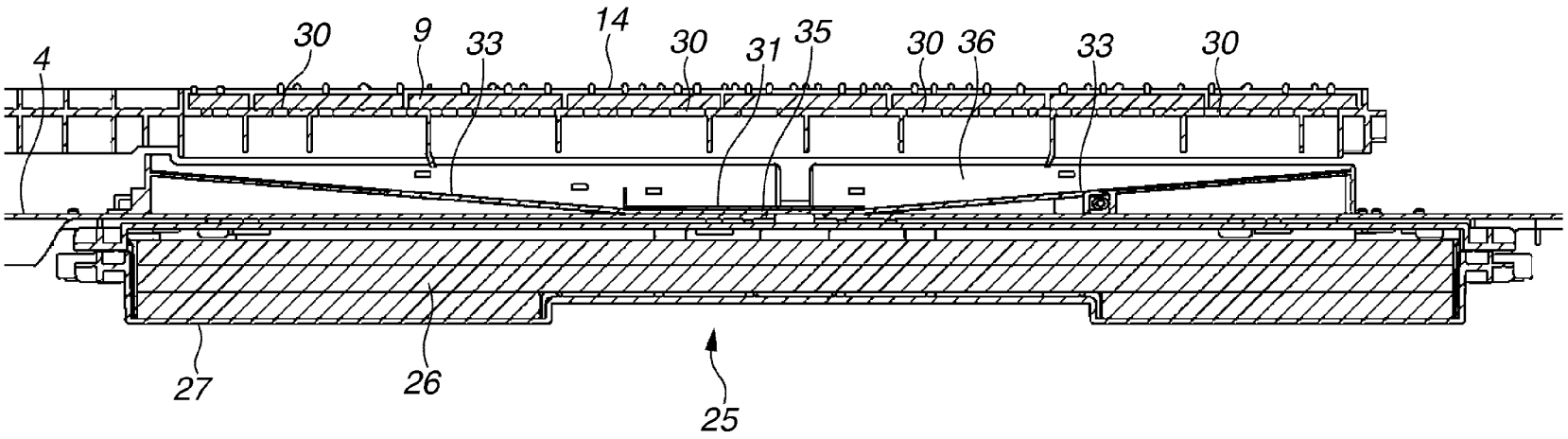
FIG. 3 is a front view illustrating a waste ink path.
Figure 4:
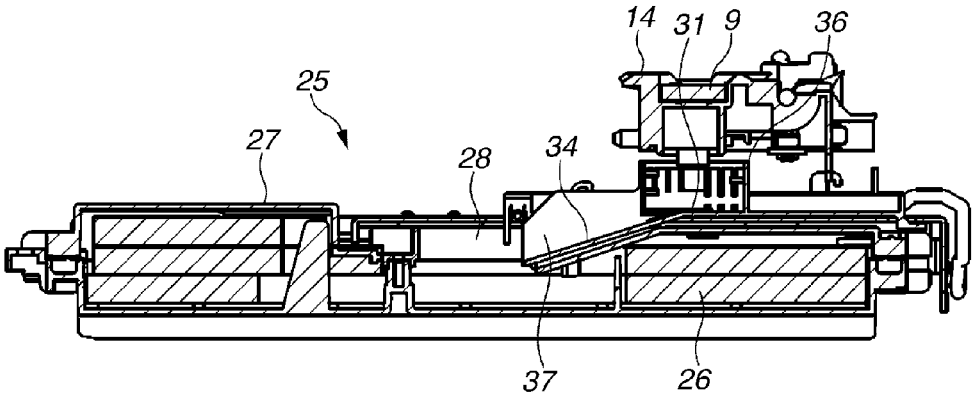
FIG. 4 is a side view illustrating the waste ink path.
Figure 5:
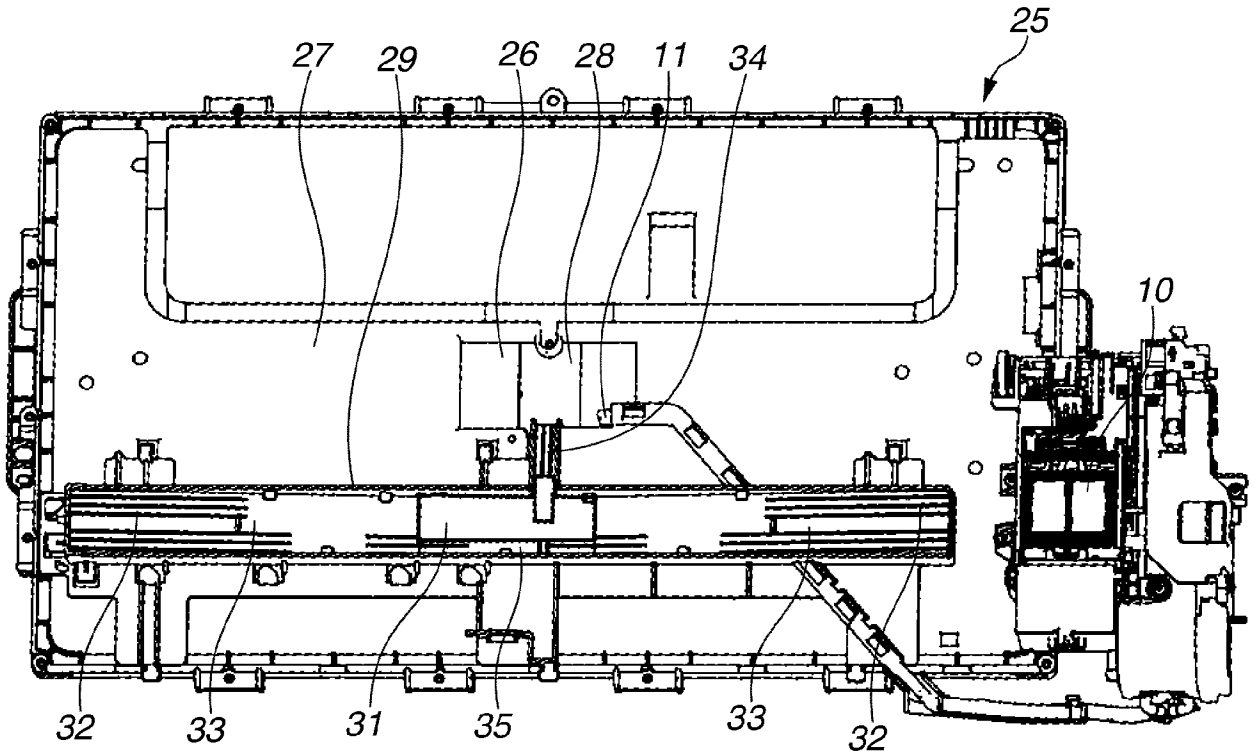
FIG. 5 is a top view illustrating the waste ink path.

Next, a waste ink flow path member 29 will be described with reference to FIGS. 3 to 5. The waste ink flow path member 29 is configured to store waste ink (first waste ink) overflowing the platen absorber 9 in a waste ink storage unit 25 which is arranged on a bottom housing 3. FIG. 3 is a front view illustrating a waste ink path. FIG. 4 is a side view illustrating the waste ink path. FIG. 5 is a top view illustrating a waste ink path.

When the amount of the ink absorbed by the platen absorber 9 exceeds the maximum retaining capacity of the platen absorber 9, the waste ink overflowing the platen absorber 9 drips down from the platen 14 via through holes 30. The through holes 30 are formed in the bottom part of the platen 14 opposite to the top opening. To facilitate dripping of the waste ink, a plurality of through holes 30 are desirably formed in positions corresponding to the side edges of a recording sheet and in positions where a preliminary discharge is performed.

The waste ink dripping from the through holes 30 reaches the top surface of a bottom frame 4 which is arranged immediately below the platen 14. The top surface of the bottom frame 4 includes first inclined surfaces 33 and a waste ink receiving surface 35, which constitute a waste ink receiving unit 36 of the waste ink flow path member 29. The waste ink receiving surface 35 is formed to be continuous with the bottom ends of the first inclined surfaces 33. In the present exemplary embodiment, the waste ink receiving surface 35 is a horizontal surface orthogonal to the direction of gravity. The waste ink having reached the first inclined surfaces 33 flows to the waste ink receiving surface 35 by its own weight. A porous body sheet 31 is attached to the waste ink receiving surface 35 with a double-sided adhesive tape. The waste ink having reached the waste ink receiving surface 35 is absorbed by the porous body sheet 31. In the present exemplary embodiment, the first inclined surfaces 33 are set at an inclination angle of 5° with respect to the horizontal plane (the waste ink receiving surface 35) so that the waste ink flows down the first inclined surfaces 33 by its own weight. Meanwhile, the waste ink having reached the waste ink receiving surface 35 is immediately absorbed by the porous body sheet 31. The porous body sheet 31 can be made of a polyvinyl alcohol sponge with high ink absorbability. A plurality of grooves 32 (see FIG. 5) extending along the direction of the inclination of the first inclined surfaces 33 can be formed in the first inclined surfaces 33 to facilitate the flow of the waste ink.

If there is no porous body sheet 31 on the waste ink receiving surface 35, the waste ink remaining on the waste ink receiving surface 35 will dry and firmly adhere thereto. This may cause the waste ink flowing into the waste ink receiving surface 35 to flow out of the waste ink receiving unit 36. In the present exemplary embodiment, the attachment of the porous body sheet 31 to the waste ink receiving surface 35 can prevent the waste ink from flowing out of the waste ink receiving unit 36.

In the present exemplary embodiment, as shown in FIG. 3, the waste ink receiving unit 36 is configured so that the bottom ends of the pair of first inclined surfaces 33 are opposed to each other. The waste ink receiving surface 35 is formed between the bottom ends of the pair of first inclined surfaces 33. Such a configuration can suppress an apparatus height as compared to when the waste ink receiving surface 35 is arranged at an end of the inkjet recording apparatus 1 (waste ink receiving unit 36) with a single, long first inclined surface 33.

When the amount of ink absorbed by the porous body sheet 31 exceeds the maximum retaining capacity of the porous body sheet 31, the waste ink overflowing the porous body sheet 31 (second waste ink) flows through a waste ink flow path portion 37. The waste ink flow path portion 37 includes a second inclined surface 34 which extends downward from the waste ink receiving surface 35. Like the first inclined surfaces 33, a plurality of grooves 32 extending along the direction of inclination of the second inclined surface 34 can be formed therein to facilitate the flow of the waste ink. In addition, a part of the porous body sheet 31 can be extended to the second inclined surface 34 so that the waste ink overflowing the porous body sheet 31 flows easily to the second inclined surface 34. In the present exemplary embodiment, the second inclined surface 34 is set at an inclination angle of 17° with respect to the horizontal plane (the waste ink receiving surface 35) so that the waste ink flows down the second inclined surface 34 by its own weight. The inclination angle of the second inclined surface 34 is set to be greater than the inclination angle (5°) of the first inclined surfaces 33 so that the waste ink flows down the second inclined surface 34 by its own weight even if the waste ink increases in viscosity due to moisture evaporation.

The top end of the second inclined surface 34 is arranged under the bottom frame 4. The second inclined surface 34 is extended so that the waste ink can flow from the bottom frame 4 to an opening 28 in a waste ink case 27. The waste ink flows down on the second inclined surface 34 to drip into the waste ink case 27 through the opening 28. The waste ink case 27 contains a waste ink absorber 26, which constitutes a second waste ink retaining member along with the waste ink case 27.

In the inkjet recording apparatus 1 according to the present exemplary embodiment, the opening 28 can be formed in the center of the top surface of the waste ink case 27 so that the waste ink is less likely to flow out of the waste ink case 27 when the inkjet recording apparatus 1 is left tilted to the right, left, front, or back for some time.

In the inkjet recording apparatus 1 according to the present exemplary embodiment, the porous body sheet 31 contacts neither of the platen absorber 9 and the waste ink absorber 26. There is no possibility of the waste ink flowing back because of a water head difference even if the inkjet recording apparatus 1 is left tilted to the right, left, front, or back for some time.

The inkjet recording apparatus 1 further includes a maintenance unit 10 to which a tube 11 is connected at an end. The tube 11 communicates at the other end with the opening 28 of the waste ink case 27. When the maintenance unit 10 performs a maintenance operation on the recording head 13, the resulting waste ink (third waste ink) is thus stored in the waste ink case 27.

As described above, the waste ink storage unit 25 includes the porous body sheet 31. The waste ink absorber 26 need not be replaced if the porous sheet body 31 has a capacity sufficient to store an assumed amount of the waste ink.

According to the inkjet recording apparatus 1 of the present exemplary embodiment, the waste ink absorber 26 need not be of replaceable type and the upsizing of the inkjet recording apparatus 1 can be suppressed even with the configuration that the opening of the platen 14 is located away from the waste ink absorber 26. According to the inkjet recording apparatus 1 of the present exemplary embodiment, the waste ink discharged from the recording head 13 is guided to the waste ink absorber 26 without fail. The waste ink will not flow back from the waste ink absorber 26 even if the inkjet recording apparatus 1 is tilted.

In the present exemplary embodiment, the waste ink receiving surface 35 is not limited to the horizontal surface. The waste ink receiving surface 35 may include an inclined surface that has an inclination angle smaller than those of the first inclined surfaces 33 and the second inclined surface 34 with respect to a horizontal plane. Even in such a case, similar effects can be obtained in terms of the storage of the waste ink, though with some increase in the apparatus height.

The first inclined surfaces 33 and the second inclined surface 34 each may have an inclined surface having a plurality of inclination angles, and may be an inclined surface including a curved surface.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures, and functions.

This application claims priority from Japanese Patent Application No. 2011-230857 filed Oct. 20, 2011, which is hereby incorporated by reference herein in its entirety.

What is claimed is:

1. An inkjet recording apparatus comprising:

a recording head configured to discharge ink;

a platen configured to hold a recording sheet in a position to face the recording head;

a first waste ink retaining member arranged in an opening of the platen and configured to absorb ink discharged from the recording head;

a second waste ink retaining member arranged below the first waste ink retaining member;

a pair of first inclined surfaces configured to flow waste ink overflowing the first waste ink retaining member downward, wherein a bottom end of one of the first inclined surfaces is opposed to a bottom end of the other one of the first inclined surfaces;

a waste ink receiving surface arranged between the bottom ends and including a porous body sheet for absorbing waste ink; and a second inclined surface configured to flow waste ink overflowing from the porous body sheet to the second waste ink retaining member, wherein a direction in which the second inclined surface flows ink intersects a direction which the pair of first inclined surfaces flow waste ink, wherein at least one of the first inclined surface and the second inclined surface includes a groove extending along a direction of inclination of the one of the first inclined surface and the second inclined surface, wherein an inclination angle of the second inclined surface with respect to a horizontal plane is larger than an inclination angle of the first inclined surface with respect to the horizontal plane.

2. The inkjet recording apparatus according to claim 1, wherein the second inclined surface is configured to extend from the waste ink receiving surface.

3. The inkjet recording apparatus according to claim 1, wherein a part of the porous body sheet is configured to extend to the second inclined surface.

4. The inkjet recording apparatus according to claim 1, wherein the porous body sheet includes a sponge made of polyvinyl alcohol.

5. The inkjet recording apparatus according to claim 1, further comprising a platen configured to hold a recording sheet in a position to face the recording head, the platen being configured to have an opening to allow ink discharged from the recording head to pass therethrough, wherein the first waste ink retaining member is arranged in the opening.

6. The inkjet recording apparatus according to claim 5, wherein the platen is configured to have a plurality of through holes in a bottom part thereof opposite to the opening.

7. The inkjet recording apparatus according to claim 1, further comprising a maintenance unit configured to perform a maintenance operation on the recording head, wherein waste ink generated by the maintenance operation flows to the second waste ink retaining member.

8. The inkjet recording apparatus according to claim 1, wherein the second waste ink retaining member includes a waste ink absorber and a waste ink case configured to accommodate the waste ink absorber, wherein the waste ink case is configured to have an opening in a top surface thereof.

9. The inkjet recording apparatus according to claim 1, wherein the first inclined surface is set to an inclination of 5 degrees and the second inclined surface is set to an inclination of 17 degrees, with respect to a horizontal plane.

10. The inkjet recording apparatus according to claim 1, wherein the porous body sheet is configured to contact neither of the first waste ink retaining member and the second waste ink retaining member.

* * * * *